US009302833B1

(12) United States Patent
Faye et al.

(10) Patent No.: US 9,302,833 B1
(45) Date of Patent: Apr. 5, 2016

(54) BOTTLE POURING FILM APPARATUS AND METHODS OF MAKING AND USING THE SAME

(71) Applicants: Christopher T. Faye, Crystal Lake, IL (US); Jeffery T. Faye, Jr., Chicago, IL (US); Lynn M. Faye, Crystal Lake, IL (US); Jeffery T. Faye, Sr., Crystal Lake, IL (US)

(72) Inventors: Christopher T. Faye, Crystal Lake, IL (US); Jeffery T. Faye, Jr., Chicago, IL (US); Lynn M. Faye, Crystal Lake, IL (US); Jeffery T. Faye, Sr., Crystal Lake, IL (US)

( * ) Notice: Subject to any disclaimer, the term of this patent is extended or adjusted under 35 U.S.C. 154(b) by 36 days.

(21) Appl. No.: 14/134,011

(22) Filed: Dec. 19, 2013

Related U.S. Application Data

(60) Provisional application No. 61/769,230, filed on Feb. 26, 2013, provisional application No. 61/894,782, filed on Oct. 23, 2013.

(51) Int. Cl.
*B65D 69/00* (2006.01)

(52) U.S. Cl.
CPC ..... *B65D 69/00* (2013.01)

(58) Field of Classification Search
CPC ..... B65D 69/00
USPC ..... 222/566, 571; 283/103, 105, 101, 100
See application file for complete search history.

(56) References Cited

U.S. PATENT DOCUMENTS

| | | | | | |
|---|---|---|---|---|---|
| 581,494 | A * | 4/1897 | Schwab | 40/310 |
| 814,592 | A * | 3/1906 | Duane | 40/306 |
| 1,004,055 | A * | 9/1911 | Martin et al. | 40/306 |
| 3,524,782 | A * | 8/1970 | Buske | 156/248 |
| 4,359,358 | A * | 11/1982 | Hattemer | 156/248 |
| 4,621,837 | A * | 11/1986 | Mack | 283/105 |
| 5,127,676 | A * | 7/1992 | Bockairo | 283/81 |
| 5,263,743 | A * | 11/1993 | Jones | 283/81 |
| 5,651,481 | A * | 7/1997 | Jensen | 222/566 |
| 6,332,631 | B1 * | 12/2001 | Kirk | 283/81 |
| 6,594,927 | B2 * | 7/2003 | Witkowski | 40/310 |
| 7,438,322 | B2 * | 10/2008 | Miller | 283/81 |
| 2005/0023308 | A1 * | 2/2005 | Burato et al. | 222/569 |
| 2008/0283537 | A1 * | 11/2008 | Smith et al. | 220/713 |
| 2009/0272769 | A1 * | 11/2009 | Contreras et al. | 222/420 |
| 2010/0116854 | A1 * | 5/2010 | Gumpold | 222/566 |

* cited by examiner

*Primary Examiner* — Donnell Long
(74) *Attorney, Agent, or Firm* — Scherrer Patent & Trademark Law, P.C.; Stephen T. Scherrer; Monique A. Morneault

(57) ABSTRACT

The present invention relates to a bottle pouring film. Specifically, a film is provided on a face of a bottle or on the neck thereof, having a shape, the shape of which can be curled into a pouring spout that may be placed within the neck of a bottle to aid in pouring fluids out of the same without spillage. The film may preferably be provided over the label of the bottle, and may be peeled from the same for use as a pour spout. Methods of making and using the same are further provided.

16 Claims, 6 Drawing Sheets

BOTTLE POURING FILM APPARATUS AND METHODS OF MAKING AND USING THE SAME

The present invention claims priority under 35 U.S.C. 119 to U.S. Provisional Patent Application No. 61/769,230, filed Feb. 26, 2013 and U.S. Provisional Patent Application No. 61/894,782, filed Oct. 23, 2013, each of which is titled "Bottle Pouring Film Apparatus and Methods of Making and Using the Same," each of which is also incorporated herein by reference in their entireties.

TECHNICAL FIELD

The present invention relates to a bottle pouring film. Specifically, a film is provided on a face of a bottle or on the neck thereof, having a shape, the shape of which can be curled into a pouring spout that may be placed within the neck of a bottle to aid in pouring fluids out of the same without spillage. The film may preferably be provided over the label of the bottle, and may be peeled from the same for use as a pour spout. Methods of making and using the same are further provided.

BACKGROUND

It is, of course, generally known to pour fluids from a bottle. Specifically, bottles are generally rigid containers having long, narrow necks with mouths at the top thereof. Bottles may be used for storing liquids therein, which may be poured by tipping the bottles and allowing the fluid to move via gravity through the neck and out the mouth. Indeed, bottle fragments have been found in the earliest human civilizations, and were typically used for storing and dispensing fluids for imbibing, or oils for use in lamps or perfumes and the like.

Bottles are particularly useful for storing wine and are very important to the history of wine development. Specifically, the development of a high quality stoppers such as wooden corks allowed for long-term storage and aging of the wine. In fact, the development of the glass bottle and stopper combination allowed production and storage of wine at the producer instead of at the retailer, which significantly impacted the quality of wine produced and distributed to the paying public.

Pouring wine or another fluid from a bottle can oftentimes lead to messes and wastefulness of product. Because the lip around the mouth of a bottle is typically relatively thick, it is often difficult to ensure that fluids dispensed from a bottle were fully dispensed to a waiting receptacle, such as a wineglass or other receptacle. Oftentimes, fluids, upon dispensing, would stay around the lip of the mouth of the bottle, and eventually drip down the side of the wine bottle, causing mess. In many cases, a dispenser would be required to wipe the mouth of the bottle with a towel to prevent drips from flowing out of the mouth and down the side of the bottle upon dispensing.

Recently, aids for pouring fluids from bottles have been developed to prevent drips and the like during dispensing of the same. For example, U.S. Pat. No. RE38,859 relates to a drip catcher intended for preventing dripping and drops seeping from a bottle orifice during dispensing of the same. The drip catcher consists of a piece of flexible and elastic foil material, preferably plastic material foil having a thickness of 0.1 to 0.2 mm. The diameter of the piece of material may be 60-80 mm. When used as a drip catcher, the piece of material is rolled into an oblong cylindrical form and inserted in the mouth of the bottle. Due to its elasticity the piece of material will positively engage the mouth and constitute a tube-formed outlet spout. Due to the small thickness of the foil material and its liquid-repellant nature, the spout cuts off the jet of fluid dispensed from the bottle very efficiently.

However, the drip catcher, as noted above in U.S. Pat. No. RE38,859 typically is distributed separately from the bottle with which it is used. Thus, unless a supply of drip catchers is handy, a dispenser of the fluid from the bottle will find it necessary to find one prior to use to obtain the benefits of the same.

Moreover, the drip catchers utilized in practice are resilient, and users of the same may be tempted to re-use drip catchers from one bottle to the next. Unless cleaned properly, this may cause contamination of a bottle with bacteria, viruses, fungi or the like, especially if time passes between uses. Moreover, due to the resiliency of the material used for the drip catchers, upon usage of the same it is likely that the drip catchers will be disposed of in garbage receptacles. Typically, the plastics and foils utilized in the construction of the drip catchers will not easily break down in the environment, causing pollution.

A need, therefore, exists for a bottle pouring film apparatus and methods of making and using the same that allows the film apparatus to be provided directly on the bottle to be poured. More specifically, a need exists for a bottle pouring film apparatus that may easily be removed from a bottle and utilized to aid in the pouring of fluids from the same.

In addition, a need exists for a bottle pouring film apparatus that is hygienic, and utilized once prior to degradation of the same. Moreover, a need exists for a bottle pouring film apparatus that prevents the spread of bacteria, viruses, fungi and other like pathogens, from contaminating bottles due to use of the same from one bottle to the next.

Further, a need exists for a bottle pouring film apparatus that degrades upon using the same over a period of time. Still further, a need exists for a bottle pouring film apparatus that may easily break down in landfills to minimize and/or prevent pollution of the same.

SUMMARY OF THE INVENTION

The present invention relates to a bottle pouring film. Specifically, a film is provided on a face of a bottle or on the neck thereof, having a shape, the shape of which can be curled into a pouring spout that may be placed within the neck of a bottle to aid in pouring fluids out of the same without spillage. The film may preferably be provided over the label of the bottle, and may be pealed from the same for use as a pour spout. Methods of making and using the same are further provided.

To this end, in an embodiment of the present invention, a bottle is provided. The bottle comprises a film disposed on a surface thereof, the film being removable and rollable into an oblong cylinder, the oblong cylinder being placed into a mouth of the bottle and used as a pour spout for fluids therein.

In an embodiment, a bottle film apparatus is provided. The bottle film apparatus comprises a film disposable on a bottle, wherein the film comprises a scored line forming a shape therein for removing the shape from the bottle when grasped and pulled by a user, said shape rollable into a tube for placement in a neck of the bottle for pouring contents from the bottle.

In an embodiment, the bottle film apparatus further comprises a label adherable to the bottle and comprising written indicia, wherein the film is adhered to the label.

In an embodiment, the shape of the film is adhered to the label, wherein a corresponding shape of the label is removed when the shape of the film is removed by the user.

In an embodiment, the film comprises written indicia thereon.

In an embodiment, the film is not adhered to the label such that the shape of the film is removed from the bottle, leaving the label adhered to the bottle.

In an embodiment, the film is a polymeric film.

In an embodiment, the film is a biodegradable polymer film.

In an embodiment, the shape is a circle.

In an embodiment, the film comprises a fluid absorbing material.

In an embodiment, the fluid absorbing material causes the film to discolor.

In an embodiment, the fluid absorbing material enhances the biodegradation of the film.

In an alternate embodiment of the present invention, a bottle film apparatus is provided. The bottle film apparatus comprises a film disposable on a neck of a bottle, wherein the film comprises a first end and a second end, and an adhesive on the first end thereof, such that when wrapped around the neck of the bottle, the adhesive on the first end of the film holds the film in place on the neck of the bottle, such that when the film is removed from the neck of the bottle, the film is rollable into a tube for placement in the neck of the bottle to aid in pouring the contents therefrom.

In an embodiment, the bottle film apparatus further comprises a tab on the first end thereof, wherein the tab is graspable by a user for pulling the film away from the neck of the bottle.

In an embodiment, the adhesive on the first end of the film adheres the first end of the film to the film.

In an embodiment, the adhesive on the first end of the film adheres the first end of the film to the neck of the bottle.

In an alternate embodiment of the present invention, a bottle film apparatus is provided. The bottle film apparatus comprises a bottle having an opening for pouring contents therefrom; a label adhered to the bottle; and a film disposed under the label for removal by a user, wherein the film is rollable into a tube for placement in a neck of the bottle to aid in pouring the contents therefrom.

In an embodiment, the film comprises a tab that extends from the film and is graspable by a user for pulling the label from beneath the label.

It is, therefore, an advantage and objective of the present invention to provide a bottle pouring film apparatus and methods of making and using the same that allows the film apparatus to be provided directly on the bottle to be poured.

More specifically, it is an advantage and objective of the present invention to provide a bottle pouring film apparatus that may easily be removed from a bottle and utilized to aid in the pouring of fluids from the same.

In addition, it is an advantage and objective of the present invention to provide a bottle pouring film apparatus that is hygienic, and utilized once prior to degradation of the same.

Moreover, it is an advantage and objective of the present invention to provide a bottle pouring film apparatus that prevents the spread of bacteria, viruses, fungi and other like pathogens, from contaminating bottles due to use of the same from one bottle to the next.

Further, it is an advantage and objective of the present invention to provide a bottle pouring film apparatus that degrades upon using the same over a period of time.

Still further, it is an advantage and objective of the present invention to provide a bottle pouring film apparatus that may easily break down in landfills to minimize and/or prevent pollution of the same.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION OF THE PRESENTLY PREFERRED EMBODIMENTS

The present invention relates to a bottle pouring film. Specifically, a film is provided on a face of a bottle or on the neck thereof, having a shape, the shape of which can be curled or otherwise rolled into a pouring spout configuration that may be placed within the neck of a bottle to aid in pouring fluids out of the same without spillage. The film may preferably be provided over the label of the bottle, and may be pealed from the same for use as a pour spout. Methods of making and using the same are further provided.

Figure 1:
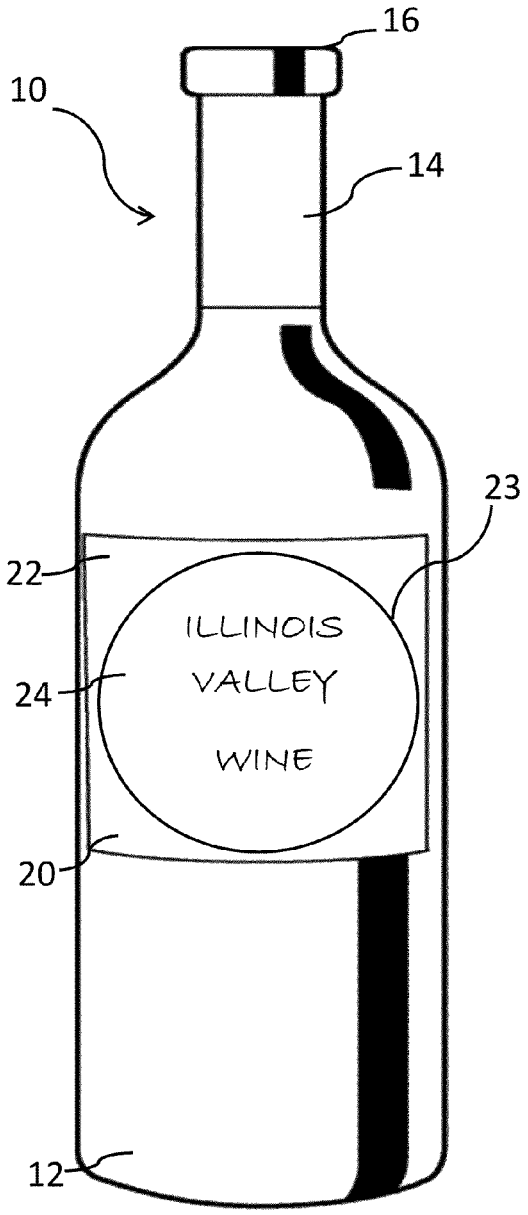
FIG. 1 illustrates a plan view of a wine bottle having a removable film for use as a pour spout in an embodiment of the present invention.

Now referring to the figures, wherein like numerals refer to like parts, FIG. 1 illustrates a bottle 10 having features typical of a bottle, such as a bottle used to store, age, and dispense wine therefrom. It should be noted that the present invention may be utilized to aid in pouring fluids from any kind of bottle or container having a mouth or orifice, and use of the term "bottle" herein is meant to be read broadly to include any like container having fluid therein for pouring out.

The bottle 10 may have a body portion 12, a neck portion 14, and a mouth 16 for dispensing fluids therefrom. The mouth 16 may have a lip 18 running around the perimeter of the mouth 16. Typically, pouring fluids directly through the mouth 16 may cause fluids to adhere or otherwise stay on the lip 18, which may cause drips to run out of the mouth down the side of the bottle, causing a mess and unsanitary conditions. Typically, the lip 18 on a bottle 10 is relatively thick, which exacerbates the collection of fluids thereon when fluids are dispensed thereon.

Disposed on the body 12 of the bottle 10 may be a label 20 that may contain written indicia and/or images that communicate to a user of the same information about the contents of the bottle 10 and/or the source of the bottle 10 and the fluids contained therein. For example, the label 20 may contain information about wine contained within the bottle 10 and the winery from which the wine is sourced. Of course, any other information may be contained on the label 20 as apparent to one of ordinary skill in the art.

Figure 2:
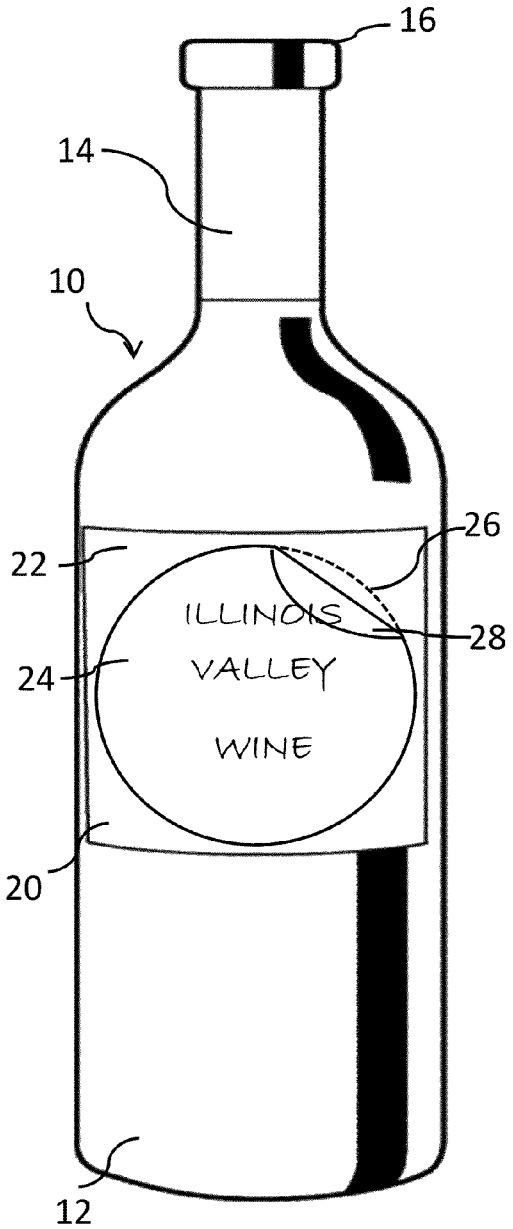
FIG. 2 illustrates a plan view of a wine bottle showing a film for use as a pour spout being removed in an embodiment of the present invention.
Figure 3:
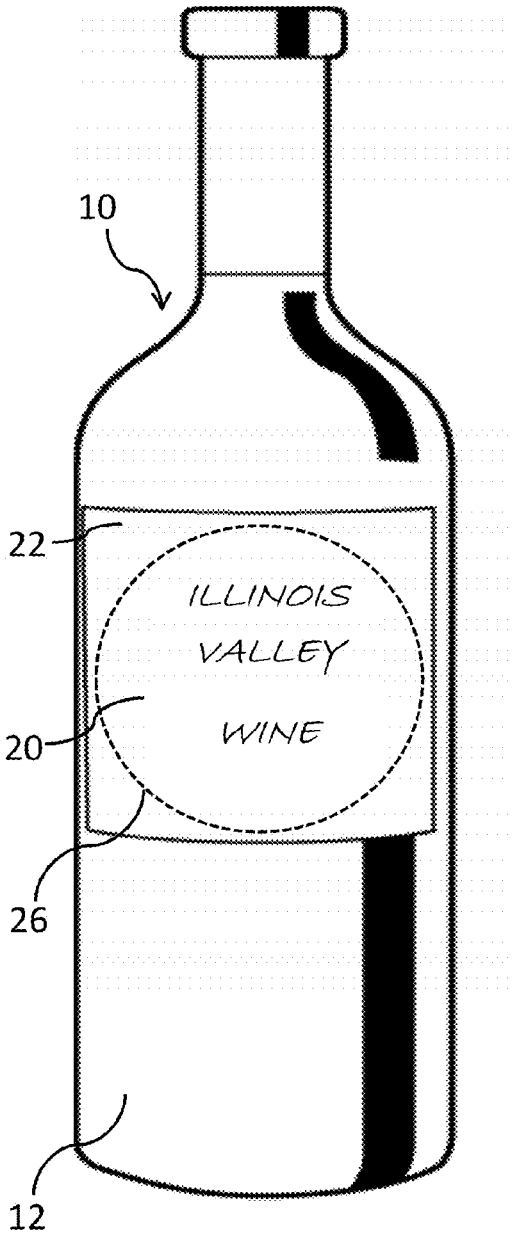
FIG. 3 illustrates a plan view of a wine bottle having a film removed over a label in an embodiment of the present invention.

Disposed over the label 20 may be a film 22 having a portion 24 that may be cut into the film 22 via one or more cut lines 23. Specifically, the portion 24 may be die cut or otherwise configured to be removable from the film 22. As illustrated in FIG. 2, the portion 24 may be pulled from the remainder of the film 22. A cut edge 26 may be left on the film 22, and the portion 24 may be completely removed from the remainder of the film 22. Preferably, a tab 28 may be provided allowing a user to grip the portion 24 and remove the same from the remainder of the film 22, as illustrated in FIG. 3. The remainder of the film 22 may be adhered to the label 20 and/or the bottle 10 via, preferably, permanent adhesive and may stay behind after removal of the portion 24. The portion 24 may be connected to the remainder of the film 22 via strategically placed cut lines 23, preferably with interruptions therein such as a dashed line, so that pulling the same allows removal and breaks interruptions within the cut line 23.

The film 22 may be any polymeric film that may be placed and adhered over the label 20. Preferably, the film 22 may be transparent or translucent to view the indicia on the label 20. Alternatively, the film 22 may have indicia thereon as well, such that removal of the portion 22 removes the indicia that may be contained on the film 22, allowing users to view the indicia on the portion 24 after the same is removed from the remainder of the film 22.

Alternatively, the portion 24 may be disposed over the label 20 without any remainder of film left behind after removal of the portion 24. Specifically, the portion 24 may be adhered to the label 20 with a removable adhesive, allowing the portion 24 to be removed from the label 20 by pulling the same. Thus, only the label 20 may be left behind in such an embodiment.

Figure 4:
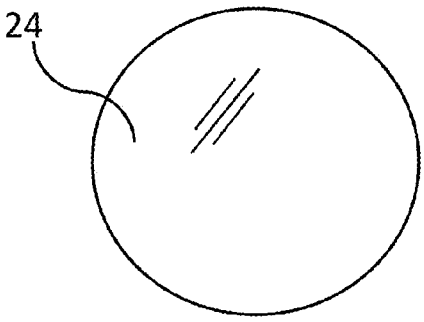
FIG. 4 illustrates a plan view of a film used as a pour spout in an embodiment of the present invention.
Figure 6:
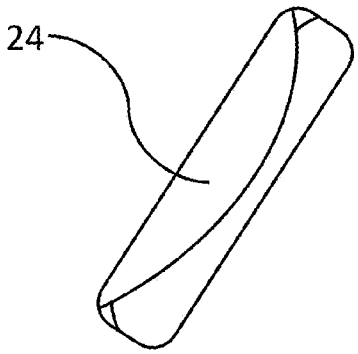
FIG. 6 illustrates a film rolled into a pour spout in an embodiment of the present invention.
Figure 7:
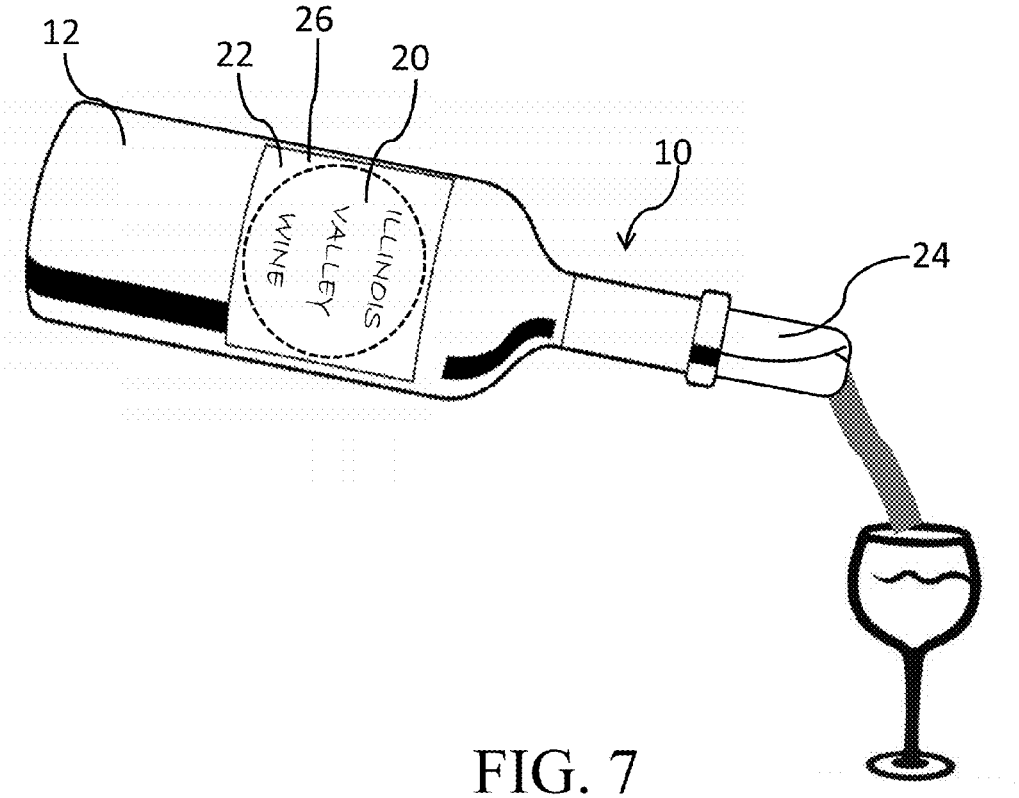
FIG. 7 illustrates a film rolled and used as a pour spout in a bottle to dispense fluids therefrom in an embodiment of the present invention.

The portion 24, illustrated in FIG. 4, is represented as having a circular shape. Indeed, the circular shape may allow the portion 24 to be rolled, as illustrated in FIG. 6, and utilized as a pour spout in the bottle 10 to dispense fluids therefrom, as illustrated in FIG. 7. It should be noted however, that portion 24 may be any shape that allows a user to roll the same and use the same as a pour spout in the bottle 10, as illustrated in FIG. 7, and many shapes are known to provide this utility and function, such as geometric shapes, or any other shape. The invention should not be limited by the shape of the portion 24.

Figure 5:
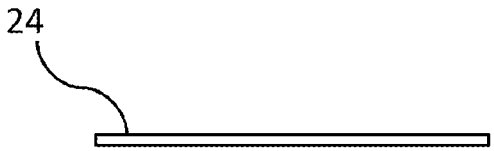
FIG. 5 illustrates a side view of a film used as a pour spout in an embodiment of the present invention.

FIG. 5 illustrates a side view of the portion 24, illustrating that the portion 24 may be relatively thin so as to be rollable into an oblong cylinder and utilized as a pour spout, as illustrated in FIG. 7. The portion 24 may be any thickness allowing the same to be useful as a pour spout. Preferably, the portion 24 may have a resiliency and elasticity to allow the same to be placed through the mouth 16 of the bottle and engaged to the inside of the neck 14 thereof to hold the same in place when being used to dispense fluids therefrom. Due the thinness of the portion 24, the pour spout made therefrom cuts off the jet of fluid efficiently, minimizing or eliminating dripping from the same. Thus, messes may be contained, and a user need not worry about drips causing unhygienic situations.

In an embodiment, the film 22 and/or the portion 24 may be made from a standard thermoplastic material having sufficient elasticity and resiliency to be used as a pour spout, as described above. In a preferred embodiment, the film 22 and/or the portion 24 may be made from a biodegradable thermoplastic material, such as, for example, polyvinyl acetate (PVA) or another biodegradable film material that may allow the portion 24 to be used as a pour spout for a limited period of time, or for a limited number of pours from the bottle 10. Thus, a user may be encouraged to use the portion 24 as a pour spout for the bottle 10 without using the same for additional bottles. Thus, the present invention may ensure that cross-contamination may not occur between bottles, and more importantly, that bacteria, viruses, fungi, or other pathogens may not form and be transferred from one bottle to another. In an alternate embodiment, the portion 24 may include or otherwise be made from a fluid absorbing material that may start to absorb and/or discolor the portion 24 when used, alerting a user that the same has been used previously so that the user will not attempt to use in a different bottle of wine. Moreover, a fluid absorbing material may encourage the environmental breakdown of the portion 24 so that the same physically cannot be used in a different bottle of wine, or over an extended period of time.

While the portion 24 is described as being disposed over the label 20, it should be noted that the portion 24 may be disposed anywhere on the bottle apparent to one of ordinary skill in the art, such as on a side thereof, on the back thereof, or even on the bottom thereof. The present invention merely describes a preferred embodiment where the portion 24 may be incorporated with the label 20, so that the same may be conveniently added to the bottle 10, such as at the same time as the label. In an embodiment, the label 20 and the film 22 may be constructed and disposed together prior to placing the label 20 on the bottle 10. Alternatively, the label 20 may be placed on the bottle 10 in a first step, and the film 22 may be added over the label 20 in a second step. The cut lines 23 may be added to the film 22 when disposed over the label 20 or prior to being disposed over the label 20, and the invention should not be limited in any manner.

Figure 8:
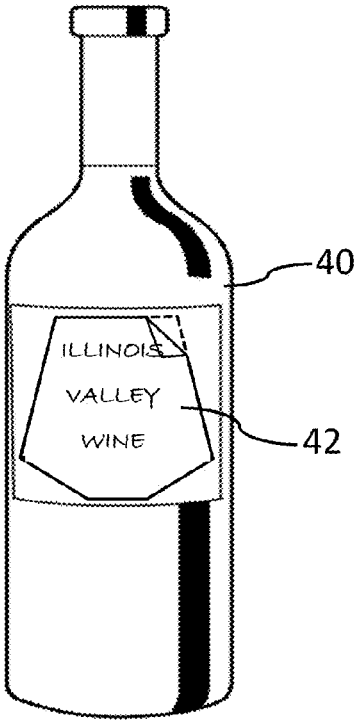
FIG. 8 illustrates an alternate embodiment of a film disposed on a surface of a bottle in an embodiment of the present invention.

Moreover, it should be noted that the shape of the film 22 that may be removed from the bottle is shown in FIGS. 1-7 as round, the shape may be any shape apparent to one of ordinary skill in the art to allow the same to be rolled, in the manner described in FIG. 6, so as to be inserted into the mouth of the bottle and used as a pour spout. For example, as illustrated in FIG. 8, removable film 42 is illustrated as having a complex geometric shape, such as hexagonal. When peeled from the bottle 40, the removable film 42 may be rolled in the manner illustrated in FIG. 6 to form a pour spout.

Figure 9:
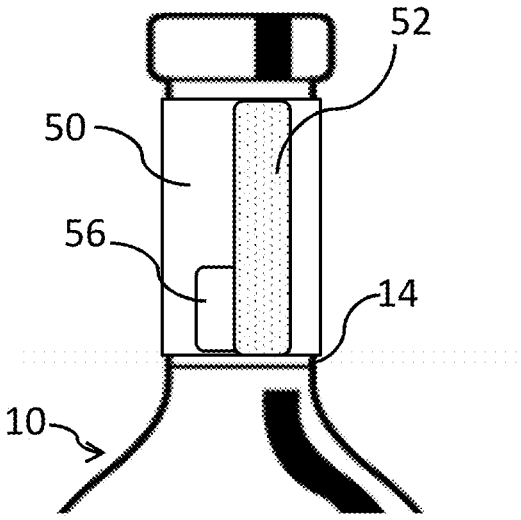
FIG. 9 illustrates an alternate embodiment of a film disposed around a neck of a bottle for use as a pour spout in an embodiment of the present invention.

FIG. 9 illustrates an alternative embodiment of the present invention of a film 50 disposed around the neck 14 of the bottle 10. Specifically, the film 50 may be made from the same material as described above with respect to the film 22 and/or the portion 24. When unrolled, the film 50 may simply be rectangular in shape, or may be any other shape apparent to one of ordinary skill in the art, but useful for the function and utility of the present invention. On an end 52 of the film 50 may be an adhesive 54 allowing the end 52 to be adhered to the film 50, allowing the same to remain thereon until use. The adhesive 54 may preferably be a pressure sensitive adhesive allowing the end 52 to be removed from the film 50. In an embodiment, the adhesive may be disposed directly on the film 50 and removed therefrom when the end 52 is removed. Alternatively, an adhesive removable area of the film 50 may aid the end 52 is being removed, such as an area having a silicone material thereon, allowing removal of the end 52 easily.

To aid in the removal of the end 52 and, thus, the film 50 from the neck 14 of the bottle 10 may be a pull tab 56 that may freely hang allowing a user to grip the same and pull the end 52 from the film 50.

Once removed from the bottle 10, the film 50 may be configured into an oblong cylinder, as illustrated in FIG. 9 to be used as a pour spout, as described above with reference to the portion 24. The adhesive 54 may further allow the film to remain configured in an oblong cylinder for use thereof.

Figure 10:
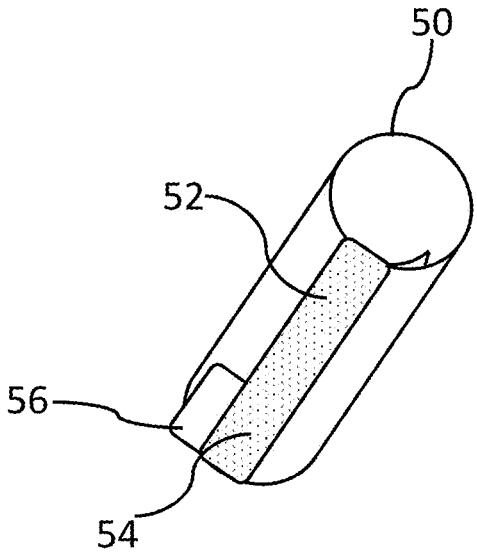
FIG. 10 illustrates a film removed from a neck of a bottle and rolled for use as a pour spout in an embodiment of the present invention.
Figure 11:
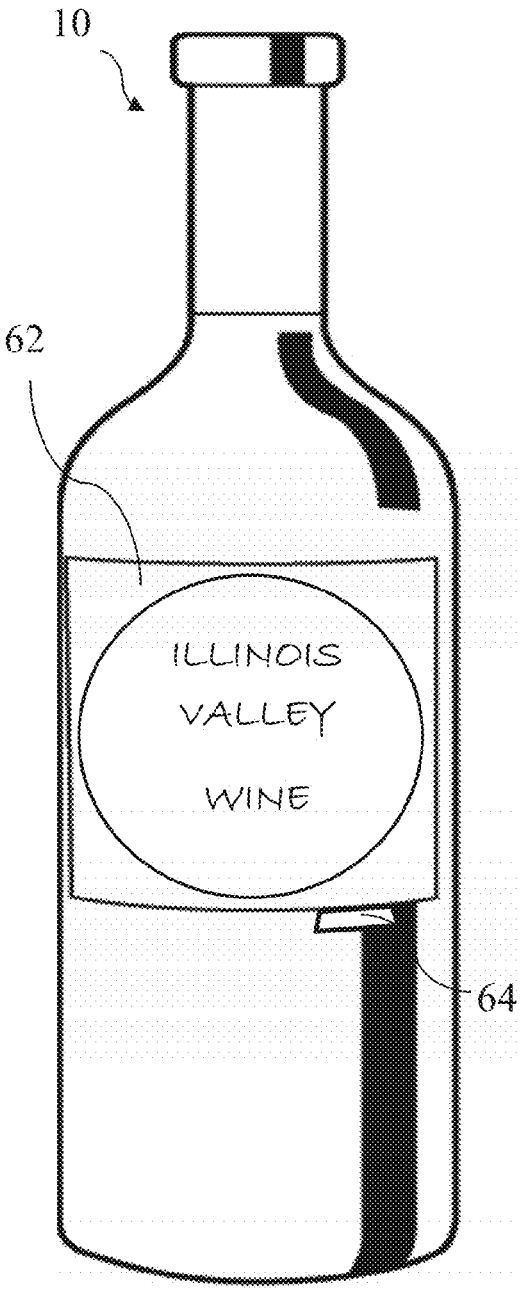
FIG. 11 illustrates an alternate embodiment of a film disposed beneath a label on a bottle for use as a pour spout in an alternate embodiment of the present invention.

Although the embodiment illustrated in FIGS. 9 and 10 is held onto the neck 14 of the bottle 10 via adhesive 54, it should be noted that the film 50 may be held via any other means apparent to one of ordinary skill in the art, and the invention should not be limited as described herein. For example, the film 50 may be tied thereon, held on via a rubber band or the like, or cut from a larger film, the remainder of which may remain adhered to the neck 14 of the bottle 10.

Figure 12:
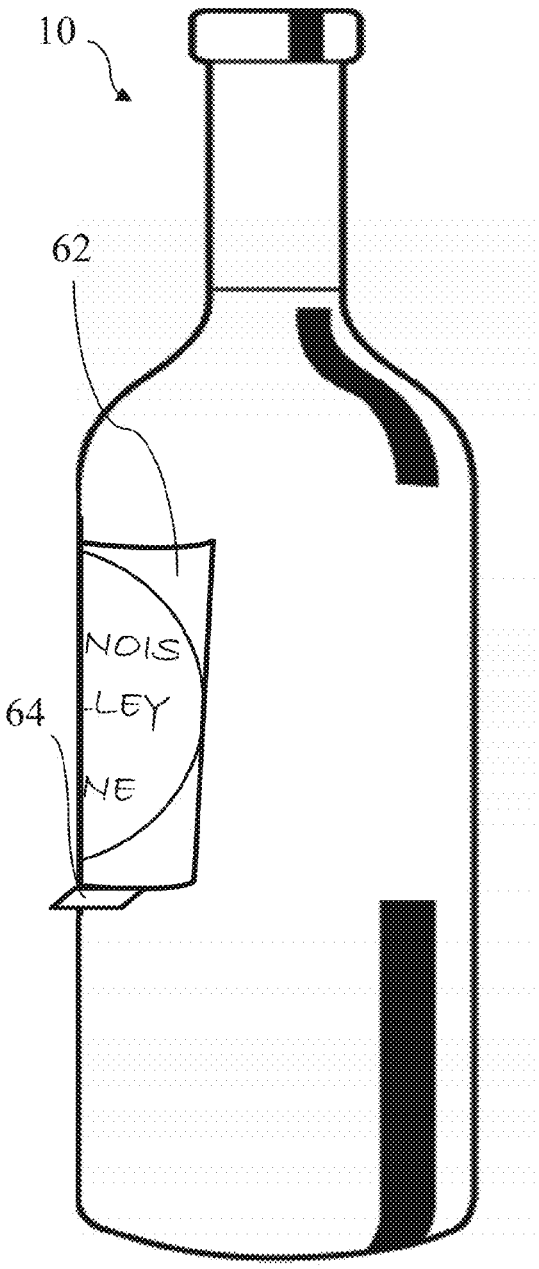
FIG. 12 illustrates a side view of the film disposed beneath the label of the bottle in the embodiment in FIG. 11.

FIGS. 11-14 show another embodiment of the present invention. A film 60 may be disposed beneath a label 62 on the bottle 10. The label 62 may be adhered to the bottle 10 on a number of sides such that a space is created between the label 62 and the bottle 10 that allows the film 60 to be placed therein and removed therefrom. The film 60 may comprise a flexible tab 64 extending away and out from the label 62. When not in use, the flexible tab 64 may be disposed against the bottle 10 and may be adhered with a removable non-toxic adhesive. The flexible tab 64 may be peeled away from the bottle 10 and label 62 and may preferably be bent as shown in FIG. 12 to aid in the removal of the film, as disclosed in more detail below.

Figure 13:
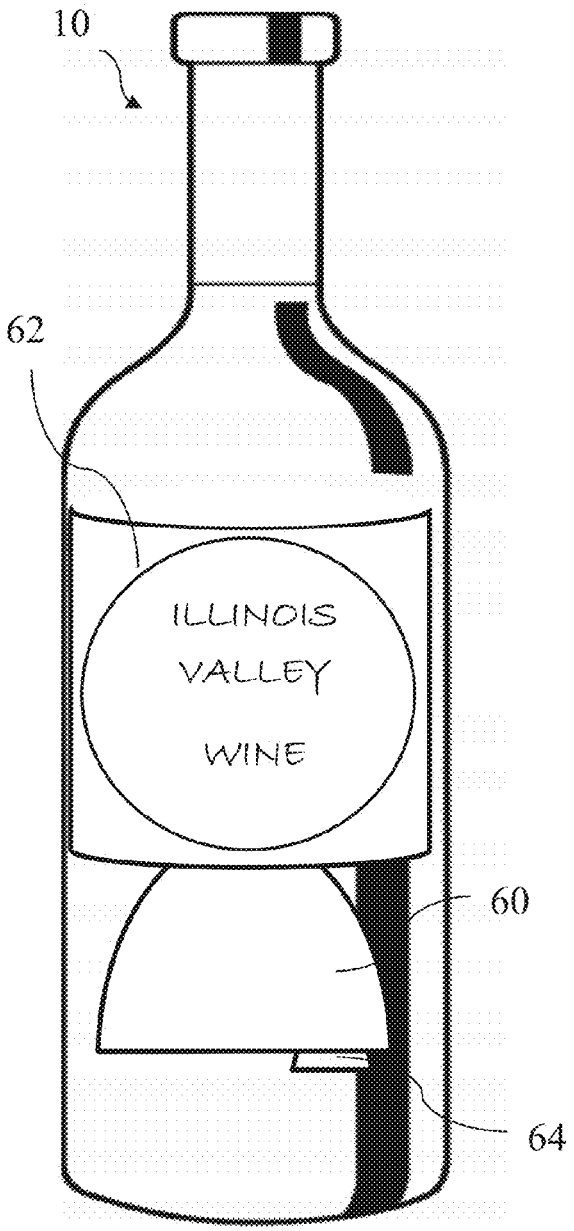
FIG. 13 illustrates a front view of a film of the present invention being removed from beneath the label of a bottle.
Figure 14:
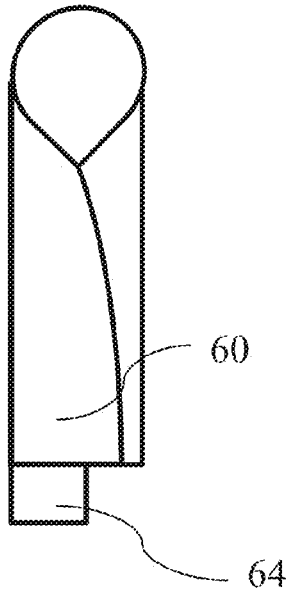
FIG. 14 illustrates a front view of a film removed from beneath the label of a bottle and rolled for use as a pour spout in an embodiment of the present invention.

The flexible tab 64 may be used to remove the film 60 from beneath the label 62 as shown in FIG. 13. Once the film 60 has been removed, the film 60 may be rolled as described herein to create a pour spout, as shown in FIG. 14. Of course, the film 60 may be replaced beneath the label 62 when not in use. The flexible tab 64 may be flattened so that the film 60 may fit within the neck of the bottle 10 when it has been rolled into a pour spout and may be flattened when the film 60 is replaced beneath the label 62. The film 60 may be removed in any way known to one skilled in the art and is removed from below in the figures as an example only.

Additionally, the flexible tab 64 may be bent inwardly when the film 60 is rolled into a pour spout. The flexible tab 64 may be adhered to the film 64 with the same adhesive that adheres the flexible tab 64 to the bottle 10 when not in use. The flexible tab 64 may hold the film 60 in the pour spout configuration for use thereof.

The invention illustratively disclosed herein suitably may be practiced in the absence of any element which is not specifically disclosed herein. It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A bottle film apparatus comprising:

a bottle comprising a label comprising written indicia;

a film disposed over the label wherein the film is configured to be removed from the bottle when grasped and pulled by a user, said film configured to be rolled into a tube and placed in a neck of the bottle for pouring contents from the bottle;

a score line in the film forming a scored shape, wherein the scored shape of the film is configured to be removed when grasped and pulled by the user, wherein the film is adhered to the label, and further wherein the label has a corresponding score line forming the scored shape, wherein both the scored shape of the label and the scored shape of the film are configured to be removed together.

2. The bottle film apparatus of claim 1 wherein the film comprises written indicia thereon.

3. The bottle film apparatus of claim 1 wherein the film is a polymeric film.

4. The bottle film apparatus of claim 1 wherein the film is a biodegradable polymer film.

5. The bottle film apparatus of claim 1 wherein the shape is a circle.

6. The bottle film apparatus of claim 1 wherein the film comprises a fluid absorbing material.

7. The bottle film apparatus of claim 6 wherein the fluid absorbing material causes the film to discolor.

8. The bottle film apparatus of claim 6 wherein the fluid absorbing material enhances the biodegradation of the film.

9. A bottle film apparatus comprising:

a film disposable on a bottle, wherein the film comprises a scored line forming a shape therein for removing the shape from the bottle when grasped and pulled by a user, said shape rollable into a tube for placement in a neck of the bottle for pouring contents from the bottle;

a label adherable to the bottle and comprising written indicia, wherein the film is adhered to the label, wherein the shape of the film is adhered to the label, wherein a corresponding shape of the label is removed when the shape of the film is removed by the user.

10. The bottle film apparatus of claim 9 wherein the film comprises written indicia thereon.

11. The bottle film apparatus of claim 9 wherein the film is a polymeric film.

12. The bottle film apparatus of claim 9 wherein the film is a biodegradable polymer film.

13. The bottle film apparatus of claim 9 wherein the shape is a circle.

14. The bottle film apparatus of claim 9 wherein the film comprises a fluid absorbing material.

15. The bottle film apparatus of claim 14 wherein the fluid absorbing material causes the film to discolor.

16. The bottle film apparatus of claim 14 wherein the fluid absorbing material enhances the biodegradation of the film.

* * * * *